United States Patent [19]

Payre et al.

[11] Patent Number: 4,682,476

[45] Date of Patent: Jul. 28, 1987

[54] THREE-PHASE HEAT PUMP

[75] Inventors: Didier Payre; Georges Crozat; Bernard Spinner, all of Perpignan, France

[73] Assignee: Societe Nationale Elf Aquitaine, Courbevoie, France

[21] Appl. No.: 623,964

[22] Filed: Jun. 25, 1984

[30] Foreign Application Priority Data

Jul. 1, 1983 [FR] France ..... 83 10955

[51] Int. Cl.[4] ..... F25B 17/08

[52] U.S. Cl. ..... 62/480; 62/476; 62/477; 62/235.1; 237/2 B

[58] Field of Search ..... 62/92, 93, 94, 238.3, 62/235.1, 477, 476, 483, 119, 480; 237/2 B

[56] References Cited

U.S. PATENT DOCUMENTS

| | | | |
|---|---|---|---|
| 2,144,441 | 1/1939 | Schlumbohm | 62/480 X |
| 2,182,453 | 12/1939 | Sellew | 62/94 |
| 4,411,384 | 10/1983 | Dunlap | 237/1 R |
| 4,532,778 | 9/1985 | Clark | 237/2 B |

*Primary Examiner*—Henry A. Bennet

*Attorney, Agent, or Firm*—Weiser & Stapler

[57] ABSTRACT

A thermochemical heat pump for the transfer of calories between two calorie sources (1, 4) and (2, 5). The heat pump embodies a monovariant system for which the relationship between the logarithm of the pressure and 1/T is singular and quasi-linear. Application to heating.

23 Claims, 4 Drawing Figures

THREE-PHASE HEAT PUMP

The present invention relates to a thermochemical heat pump which makes possible the transfer of calories between a first source of calories and a second source of calories.

This heat pump operates according to an intermittent cycle of heat storage and withdrawal.

There have already been proposed several types of thermochemical heat pumps featuring either continuous operation or intermittent operation and which are capable of either providing calories (heating) or of removing them (cooling).

To obtain good heat exchange between a reactive medium and the source of calories, systems have been attempted in which the reactive medium comprises a liquid phase; which is, for example, accomplished in gas-liquid absorption systems. Unfortunately, these systems have the disadvantage of being multivariant; i.e., the heat exchanges do not take place at constant temperature, which leads to numerous problems when it is desired to provide an efficient energy rating.

One can, for example, refer to the publication of F. A. Jeager and C. A. Hall "Ammoniated Salt Heat Pump, Thermal Storage System", International Seminar on Thermochemical Energy Storage, Stockholm, 1980, page 339. These authors studied the ammoniazation of $NH_4Cl$, $NH_4SCN$ and were only interested in compound regions having a single liquid phase for which the variance is two.

In contrast, this invention contemplates a monovariant system; i.e., a system in which the relationship between the logarithm of the pressure and 1/T is singular and quasi-linear.

Experiments of this type have been carried out by R. W. Mar who, in his article "Chemical Heat Pump Reactions Above the Solidus—A Feasibility Study", S.A.N.D. Report 79-8036, indicates that systems based upon the reaction of $CaCl_2$ and water, about the solidus curve, cannot be utilized to provide thermochemical heat pumps because they exhibit very low reaction rates. To the contrary, the applicants have found that it is possible to achieve thermochemical heat pumps with a monovariant three-phase system in which the absorption of gas by a saturated solution corresponds to a single equilibrium (i.e., there is a single reaction), whereas Mar believed that heat exchange took place in the course of two distinct reactions, each involving a different solid compound.

Accordingly, the invention provides a thermochemical heat pump which enables the transfer of calories from a first heat source to a second heat source using a reactive medium. The system is characterized in that the exchange of calories between one of the two sources and said reactive medium takes place by means of a reaction between a gas and a liquid phase which is constituted by a solid saturated solution or two non-miscible liquids, said reaction being monovariant.

In accordance with the invention, the exchange of calories between the second source and the reactive medium takes place by means of gas-liquid of said gas phase change reaction, this being a monovariant reaction, or by means of an absorption reaction of said gas with a solid.

The gas may consist of water vapor or ammonia, or also can be selected from methanol, ethanol, butanol, methylamine, dimethylamine, trimethylamine, ethylamine, diethylamine, the fluoroalkanes, the chlorinated fluoroalkanes, difluoromethylsilane, chlorodifluorosilane, disiloxane, propane, butane, acetone and acetaldehyde. The fluoroalkanes can be selected from $CCl_3F$, $CCl_2F_2$, $CHCl_2F$, $CHClF_2$, $Cl_3C_2F_3$, $Cl_2C_2F_4$, $C_2HClF_4$, $C_2H_2ClF_3$, $CH_2ClF$ and $C_2H_2F_4$.

Preferably, the heat pump according to the invention comprises a saturated solution, in the liquefied gas, of a solid selected from $CaCl_2$, KOH, LiCl, LiBr, $ZnCl_2$, $ZnBr_2$ and the gas, which in these cases is $H_2O$.

According to a specific form of the invention, the heat pump comprises two reactors, each placed in heat exchange relationship with one of the sources of calories, and which are connected to each other by a gas transfer tube. The gas transfer tube may optionally be provided with a compressor.

The reactor in which the monovariant reaction of the gas with the saturated solution takes place is, for best yields, provided with an agitating system.

The advantages, as well as the operation of a heat pump embodying the invention, will appear more clearly from a reading of the following description, which is provided in non-limiting manner and with reference to the drawings in which.

Figure 1:
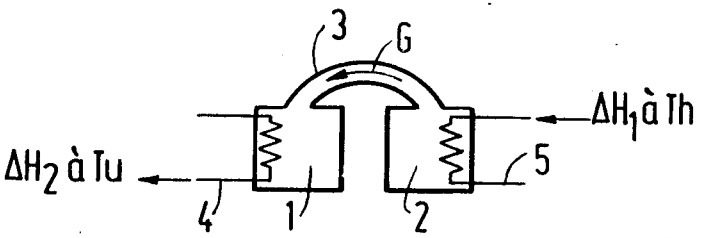
FIG. 1 shows a pump according to the invention during the storage phase
Figure 2:
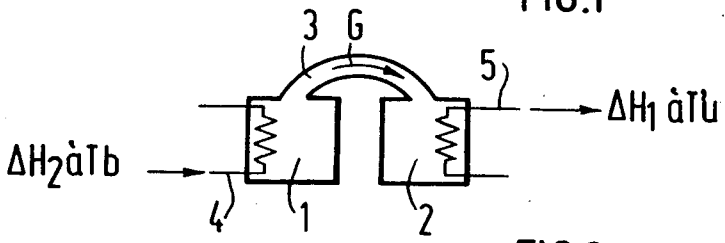
FIG. 2 shows the same pump during the withdrawal phase
Figure 3:
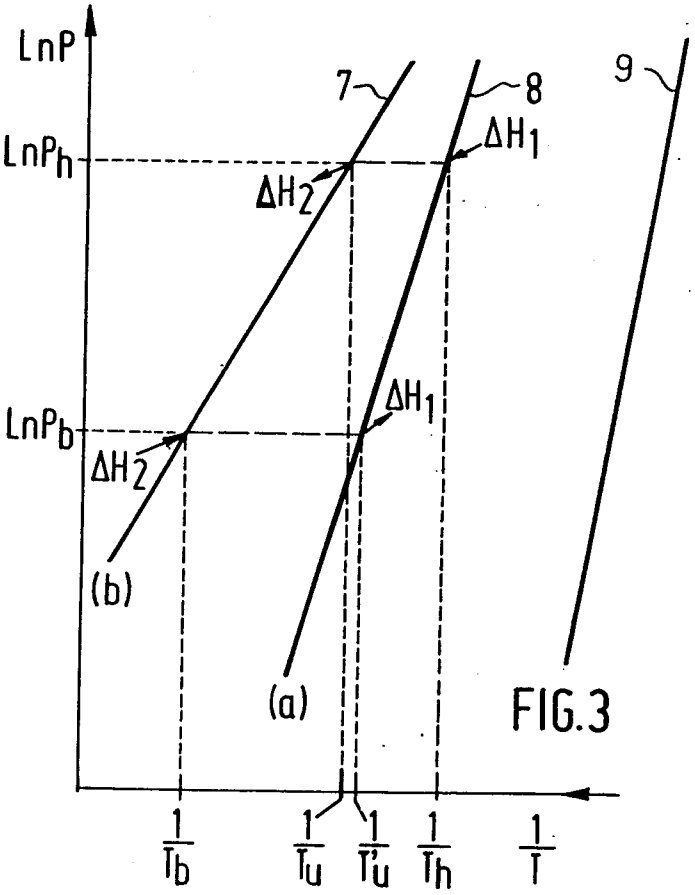
FIG. 3 is a phase diagram

In FIG. 1 there is schematically shown a heat pump during the energy storage phase. FIG. 2 shows the same pump during the withdrawal phase. FIG. 3 shows the corresponding phase diagram.

The heat pump comprises a reactor 1 and a reactor 2, connected to each other by a conduit 3. Each reactor is provided with a heat exchanger 4, 5 for providing the exchange of calories between the reactive medium and an external sources of calories.

Reactor 1 contains a liquid in equilibrium with its vapor phase. Reactor 2 contains a solid saturated solution.

In this example, the reactants and the reactions utilized are the following:

Reactor 1 - the liquid is water so that one obtains the reaction $$H_2O(1) \rightarrow H_2O(g) + \Delta H_1$$

Reactor 2 - the solid is lithium chloride monohydrate in solution in water $$LiCl.H_2O(s) + H_2O(g) \rightarrow LiCl.H_2O \text{ (saturated solution)} - \Delta H_2$$

During the withdrawal phase, the gas coming from reactor 1 condenses in the region of the saturated solution and liberates its latent heat of condensation $\Delta H$ while diluting the solution. The differential heat of dilution of the saturated solution is $\Delta H_D$, representing an exothermic reaction. Simultaneously, excess solid is dissolved in order to maintain the concentration at saturation, with a heat of dissolution $\Delta H_s$ of the salt in the saturated solution.

During the storage phase, the gas evaporates, leaving the solution contained in reactor 1 so as to pass into reactor 2, which then plays the role of condenser. The solution becomes concentrated and the solid crystalizes.

The enthalpies which are involved are the same as previously, but with opposite signs.

In principle, the enthalpies $\Delta H_D$ and $\Delta H_s$ can be neglected because they are of a much lower order of magnitude than $\Delta H_L$ and generally of the opposite sign.

With reference to FIG. 3, which is a phase diagram of the reactions involved, in which the curve 7 corresponds to the liquid-vapor equilibrium and the curve 8 corresponds to the solid+gas→saturated solution equilibrium, it is seen that if a quantity of calories $\Delta H_1$ is supplied at a temperature Th, there is recovered $\Delta H_2$ at a temperature Tu which is lower than Th.

Likewise, during the withdrawal phase, if one supplies $\Delta H_2$ at the temperature Tb, there is recovered $\Delta H_1$ at a temperature T'u which is above Tb.

For the purpose of simplification, Tu and T'u will be considered to be identical.

Thus, it is understood that during the two stages of the cycle, storage and withdrawal, heat is delivered at the temperature Tu, which corresponds to the temperature used for heating.

The usefulness of this system resides in the fact that it is monovariant in the two reactions and that the temperature Tu is therefore constant. Moreover, the exchanges of calories are facilitated by the presence of a liquid phase in each reactor.

Figure 4:
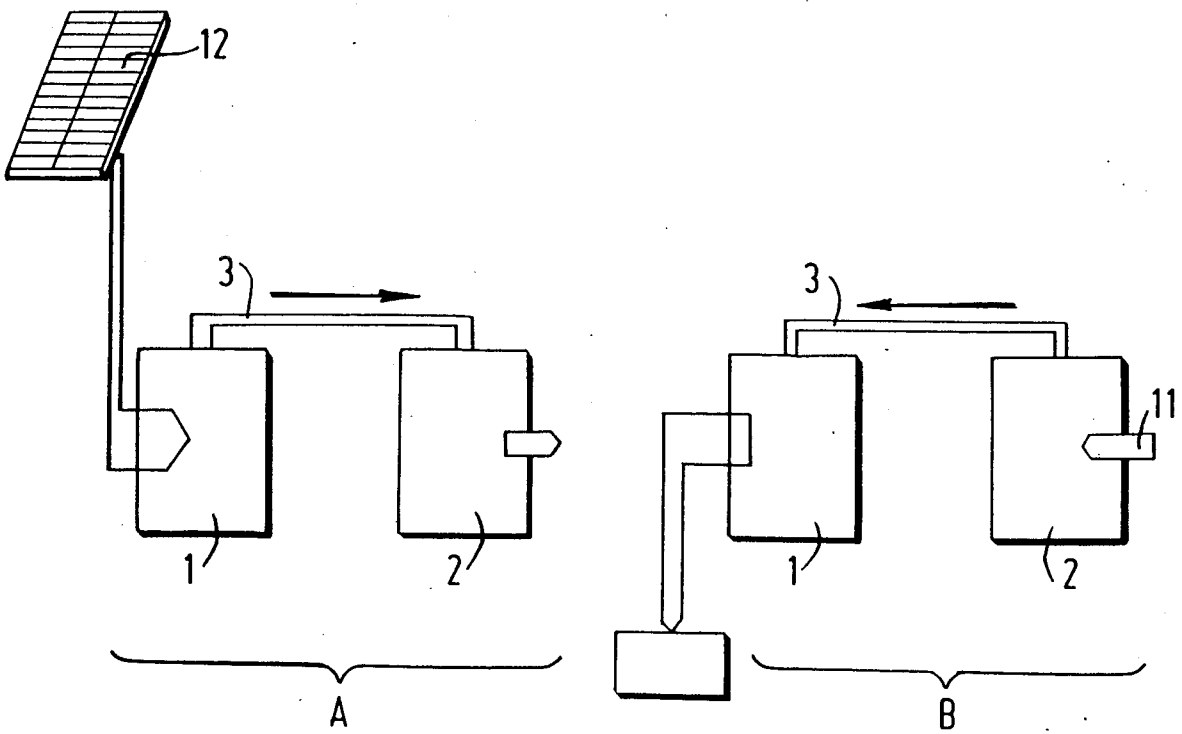
FIG. 4 is a heating system according to the invention.

FIG. 4 shows a heating system produced in accordance with the present invention and in which the heating period corresponds solely to the withdrawal phase. It will be understood that, as has been mentioned above, the system can also be used for heating during the storage phase.

Portion A of FIG. 4 represents the storage phase, whereas portion B represents the withdrawal phase.

The heat pump is symbolized by its two reactors 1 and 2 and by the gas conduit 3.

During the storage phase, the reactor 1 is connected to a heat source constituted in the installation illustrated by a solar receptor 12. The calories yielded in reactor 2, upon condensation of the gas, are discharged to the atmosphere, but could also equally well be used for heating, or could be stored.

During the withdrawal phase, the reactor 2 is supplied with calories by a cold source, symbolized by arrow 11. The calories are recovered in reactor 1 and utilized for heating.

In this illustrative embodiment, the following energy results are obtained.

The three-phase system used was a saturated solution of lithium chloride, water vapor, and lithium chloride monohydrate. For this system, the existence region of the hydrate in solid form with the saturated solution lies between 19° and 95° C. The mass storage capacity, measured between a storage operation at 90° C. and a withdrawal operation at 45° C., was 146 Wh/Kg. Finally, there was obtained during withdrawal a temperature rise of about 41° C. ($\Delta T$). The following table gives the results obtained with other salts.

| Salt | Hydrate | Existence Region | $\Delta T$ | Capacity Wh/kg |
|---|---|---|---|---|
| $CaCl_1$ | $2H_2O$ | 45-176 | 32 | 147 |
| KOH | $1H_2O$ | 33-145 | >50 | 122 |
| LiBr | $1H_2O$ | 19-95 | 41 | 146 |

On the other hand there has also been made a chemical heat pump according to the invention which utilizes a reaction of the gas with a saturated solution and an absorption reaction of the gas with a solid.

For that purpose there was used the same system as before. In the first reactor there was placed a solid saturated solution of liquid $LiCl.H_2O$.

In the other reactor there was placed a solid constituted by anhydrous lithium chloride which is capable of absorbing water vapor in order to yield LiCl $H_2O$, which is a solid.

The behavior of the phases shows that the system is monovariant.

In FIG. 3 there is shown the absorption curve LiCL-/LiCl $H_2O$, referenced by numeral 9. This curve lies to the right of the curve which corresponds to the saturated solution. The system operates as in the preceding example, with a storage phase and a withdrawal phase, and gives identical results.

However, the invention is not limited to the embodiments described. On the contrary, it encompasses all of its variants.

Thus, for example, one can provide a compressor in tubing 3 so as to improve the reaction's kinetics, or one can place an agitating apparatus in the interior of reactor 1.

We claim:

1. In a thermochemical heat pump enabling the transfer of calories from a first heat source (1, 4) to a second heat source (2, 5), using a reactive medium, the improvement comprising that the exchange of calories between one of the two sources and said reactive medium takes place by means of a reaction between a gas and a liquid phase, wherein the liquid phase is selected from a liquid phase present in the group consisting of (1) a solid and a liquid solution saturated with said solid and (2) two non-miscible liquids, said reaction being monovariant.

2. A thermochemical heat pump which comprises a first reactor, a liquid in equilibrium with its vapor phase in said first reactor, a second reactor, a reaction medium in said second reactor, comprising a two-phase medium wherein the two-phase medium is selected from the group consisting of (1) a solid and a liquid solution saturated with said solid and (2) two non-miscible liquids, a conduit connecting said first reactor and said second reactor so as to form a monovariant three-phase system, whereby an exchange of calories takes place between said first and second reactors by means of a monovariant reaction between the vapor of said first reactor and the liquid phase of said second reactor.

3. Heat pump according to claim 1, characterized in that the exchange of calories between the second source and the reactive medium takes places by means of a gas-liquid of said gas phase change reaction.

4. Heat pump according to claim 1, characterized in that the gas is water vapor.

5. Heat pump according to claim 1, characterized in that the gas is ammonia.

6. A thermochemical heat pump which comprises a first reactor, a liquid in equilibrium with its vapor phase in said first reactor, a second reactor, a reaction medium in said second reactor, comprising a two-phase medium wherein the two-phase medium is a solid and a liquid solution saturated with said solid, wherein the solid is selected from the group consisting of $CaCl_2$, KOH, $LiCl_2$, LiBr, ZnBr, $ZnCl_2$ and $ZnBr_2$ a conduit connecting said first reactor and said second reactor so as to form a monovariant three-phase system, whereby an exchange of calories takes place between said first and second reactors by means of a monovariant reaction between the vapor of said first reactor and the liquid phase of said second reactor.

7. Heat pump according to claim 6, characterized in that the gas is $H_2O$.

8. Heat pump according to claim 1, characterized in that it comprises two reactors, each placed in heat exchange relation with one of the sources and connected to each other by a gas transfer tube.

9. Heat pump according to claim 8, characterized in that the gas transfer tube is provided with a compressor.

10. Heat pump according to claim 8, characterized in that the reactor within which the monovariant reaction of the gas with the saturated solution takes place is provided with an agitation system.

11. A thermochemical heat pump which comprises a first reactor, a liquid fluoroalkane selected from the group consisting of $CCl_3F$, $CCl_2F_2$, $CHCl_2F$, $Cl_3C_2F_3$, $Cl_2C_2F_4$, $C_2HClF_4$, $C_2H_2ClF$, $C_3H_2ClF$ and $C_2H_2F_2$ in equilibrium with its vapor in said first reactor, a second reactor, a reaction medium in said second reactor comprising a two-phase medium wherein the two-phase medium is selected from the group consisting of (1) a solid and a liquid solution saturated with said solid and (2) two non-miscible liquids, and a vapor transfer conduct connecting said first reactor and said second reactor whereby an exchange of calories takes place between said first reactor and said second reactor by means of a monovariant reaction between the vapor in said first reactor and the liquid phase of said second reactor.

12. The thermochemical heat pump according to claim 11 wherein the reaction medium in said second heat source is two non-miscible liquids.

13. The thermochemical heat pump according to claim 11 including a means for agitation in said first reactor.

14. The thermochemical heat pump according to claim 11 including a compressor associated with said vapor transfer conduit.

15. The thermochemical pump according to claim 11 including a heat source associated with said first reactor.

16. The thermochemical pump according to claim 15 including a cold source associated with said second reactor.

17. A thermochemical heat pump which comprises a heat source, a first reactor containing a liquid in equilibrium with its vapor associated with said heat source, a cold source, a second reactor containing a solid saturated solution and a solid in said second reactor, and a vapor transfer conduit connecting said first and second reactor whereby an exchange of calories takes place between said first and second reactors by means of a monovariant reaction between the vapor of said first reactor and the liquid phase of said saturated solution.

18. The thermochemical heat pump according to claim 17 wherein said second reactor contains a saturated solution and a solid of a compound selected from the group consisting of $CaCl_2$, KOH, LiCl, LiBr, $ZnCl_2$ and $ZnBr_2$.

19. The thermochemical heat pump of claim 1 wherein one reactor contains a solid saturated solution and a solid and the other reactor contains a solid and a gas.

20. A thermochemical heat pump which comprises a first reactor, a liquid in equilibrium with its vapor phase in said first reactor, a second reactor, a reaction medium in said second reactor, comprising a two-phase medium consisting of a solid and a liquid solution saturated with said solid, a conduit connecting said first reactor and said second reactor so as to form a monovariant three-phase system, whereby an exchange of calories takes place between said first and second reactors by means of a monovariant reaction between the vapor of said first reactor and the liquid phase of said second reactor.

21. The thermochemical heat pump of claim 20 wherein the concentration of the saturated solution does not change.

22. The thermochemical heat pump of claim 20 wherein the reaction medium in the second reactor contains excess solid.

23. Heat pump according to claim 1, characterized in that the gas is selected from the group consisting of methanol, ethanol, butanol, methylamine, dimethylamine, trimethylamine, ethylamine, diethylamine, fluoroalkanes, chlorinated fluoroalkanes, difluoromethylsilane, chlorodifluorosilane, disiloxane, propane, butane, acetone and acetaldehyde.

* * * * *